United States Patent [19]

Hall

[11] 3,999,535

[45] Dec. 28, 1976

[54] PREFABRICATED FIREPLACE

[75] Inventor: John R. Hall, Cincinnati, Ohio

[73] Assignee: Hall Fireplace, Inc., Cincinnati, Ohio

[22] Filed: Nov. 11, 1974

[21] Appl. No.: 522,739

[52] U.S. Cl. ..... 126/121

[51] Int. Cl.[2] ..... F24B 7/00

[58] Field of Search ..... 126/121, 120, 122, 129, 126/131; 165/48, 57, 53; 237/51

[56] References Cited

UNITED STATES PATENTS

| | | | |
|---|---|---|---|
| 2,186,539 | 1/1940 | Slayter et al. | 126/121 X |
| 2,191,064 | 2/1940 | Wagner | 126/121 X |
| 2,231,258 | 2/1941 | Elmore | 126/121 X |
| 2,258,682 | 10/1941 | Kent | 126/122 X |
| 2,570,598 | 10/1951 | Roos | 126/131 X |
| 2,832,332 | 4/1958 | Johnson | 126/121 |
| 3,466,000 | 9/1969 | Southern et al. | 126/120 X |

*Primary Examiner*—William F. O'Dea
*Assistant Examiner*—Harold Joyce
*Attorney, Agent, or Firm*—Wood, Herron & Evans

[57] ABSTRACT

A forced air home heating system includes a prefabricated metal fireplace having a combustion chamber surrounded by a heat collection distribution chamber. The fireplace distribution chamber functions as the central distribution chamber for the forced air home heating system to which air is supplied from a furnace or other heat source and from which it is distributed throughout the home. If there is a fire in the fireplace, fireplace generated heat then supplements or replaces heat from the primary home heating source in the forced air system.

6 Claims, 8 Drawing Figures

PREFABRICATED FIREPLACE

This invention relates to prefabricated fireplaces and particularly to prefabricated fireplaces of the type which recirculate fireplace heated air for home heating purposes.

Conventionally, fireplaces have been constructed on a building site by skilled tradesmen utilizing hand labor to build a brick fireplace. This construction technique results in a fireplace which is aesthetically pleasing but which is expensive to construct as well as very inefficient in its use of fireplace generated heat to heat the home or building within which the fireplace is located.

The alternative to a handbuilt brick fireplace is a prefabricated metal unit. These units are much less expensive than on site constructed brick units but they are also much less decorative and less appealing to a home purchaser.

The standard metal fireplace is also an inefficient source of heat for a home, its primary utility being a decorative item rather than an efficient heat source. There have been attempts, though, to better increase the efficiency of prefabricated metal fireplaces by recirculating heated air. Such attempts are exemplified by the prefabricated fireplace units illustrated in U.S. Pat. No. 3,762,391 and U.S. Pat. No. 3,724,443. In both of these patents fireplace efficiency is increased by surrounding the fireplace combustion chamber with a heat collection and distribution chamber. Fireplace heat is collected by this chamber and then distributed from the chamber through ducts to various areas of the room or home in which the fireplace is located. These recirculating prefabricated metal fireplaces, though, are not as aesthetically pleasing in appearance as conventional brick fireplaces.

It has been a primary objective of this invention to provide a prefabricated fireplace which has the aesthetic appearance and appeal of a hand constructed brick fireplace as well as the efficiency of a recirculating type of prefabricated metal fireplace.

One aspect of this invention is predicated upon the concept of providing a prefabricated metal fireplace which includes a heat distribution chamber surrounding the fireplace for collection and distribution of fireplace generated heat but which has a masonry covering either of brick or of precast concrete. The masonry covering adds to the aesthetic appeal of the unit but also functions as a heat insulator. This masonry covering eliminates the need of all previous recirculating type metal fireplaces for circulating cooling air flow over the metal surfaces of the unit to avoid overheating and fire hazard conditions.

Another objective of this invention has been to provide a recirculating type of prefabricated fireplace in which the fireplace serves as the distribution center for a complete home heating and cooling system.

Another concept upon which this invention is predicated is that of enclosing a recirculating type of prefabicated metal fireplace within a masonry covering or enclosure but separated from the prefabricated metal section of the fireplace by a high-temperature, glass wool or other conventional high-temperature insulation. The insulation is compressible and serves the dual function of accommodating expansion and contraction of the metallic section of the unit and of insulating the masonry from the high-temperature of the metallic section of the fireplace. In the absence of the tolerance for expansion and contraction within the insulative material, expansion of the metallic section would result in breakage or damage of the masonry enclosure, irrespective of whether that covering was of brick or of precast concrete.

Another aspect of this invention is predicated upon the provision of a prefabricated metal fireplace with a surrounding framework to which the fireplace is rigidly attached by welds or other securements. In one embodiment this framework is cast within a brickfacing precast concrete. Alternatively, the framework may be used as a base for a brick enclosure. Irrespective, though, of which masonry enclosure is used, the resulting fireplace has the aesthetic appeal of a conventional handmade brick fireplace and the efficiency of a recirculating type of metal fireplace.

Another aspect of this invention is predicated upon the provision of a prefabricated recirculation type fireplace in which the fireplace includes heaters and/or air conditioners operative to heat or cool the recirculating air independently of the combustion chamber of the fireplace. The advantages of a fireplace which incorporates this concept is that it enables the fireplace and the associated heaters and ductwork to function as the complete heating system of a home. Consequently, it eliminates any redundancy of the system and maximizes the efficient use of heat from the fireplace combustion chamber.

These and other objects and advantages of this invention will be more readily apparent from the following description of the drawings in which:

FIG. 3 is an exploded perspective view of the fireplace of FIG. 1 but absent the masonry covering.

Figure 1:
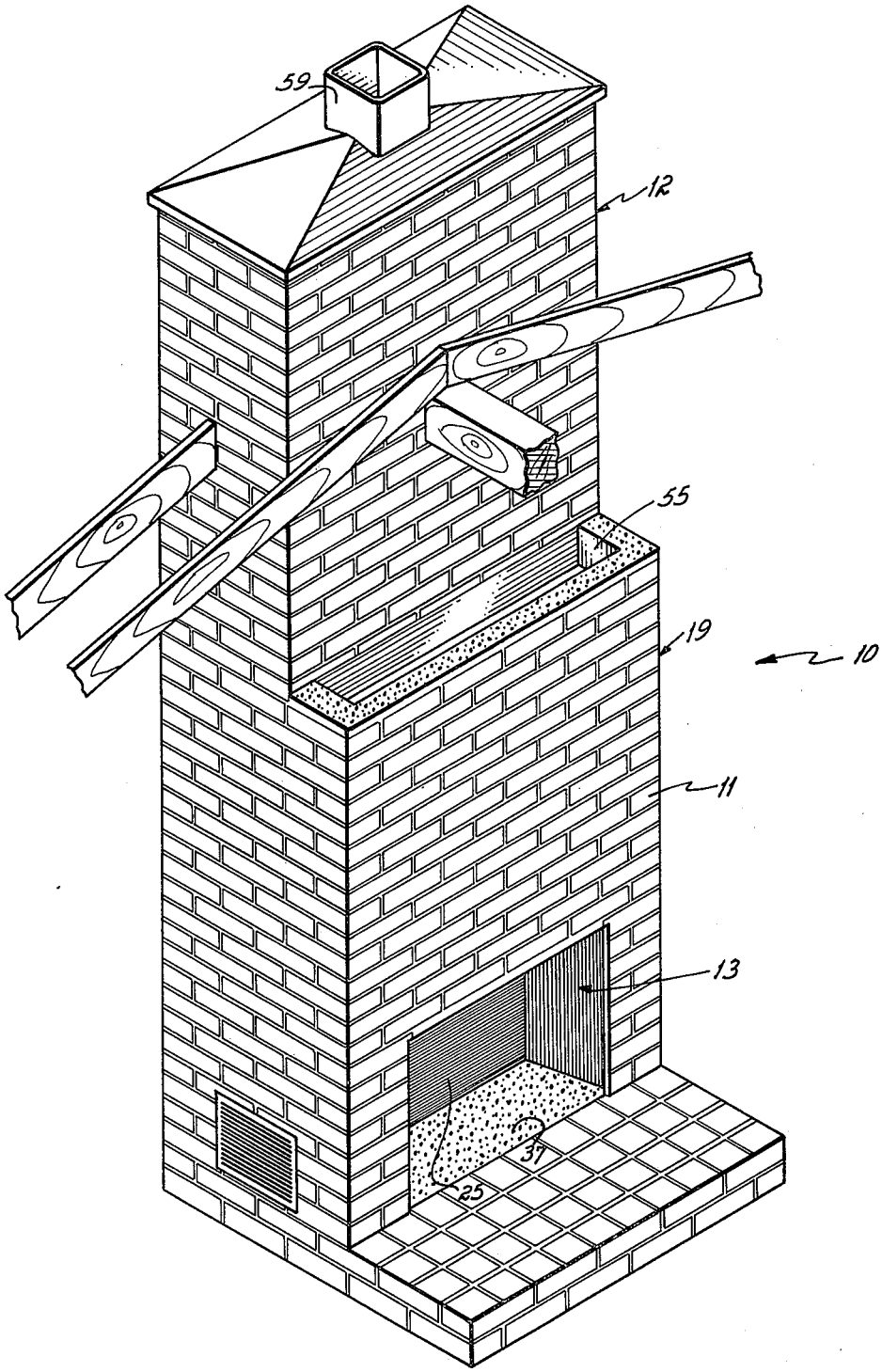
FIG. 1 is a perspective view of a fireplace made in accordance with the invention of this application.
Figures 2, 4, 5:
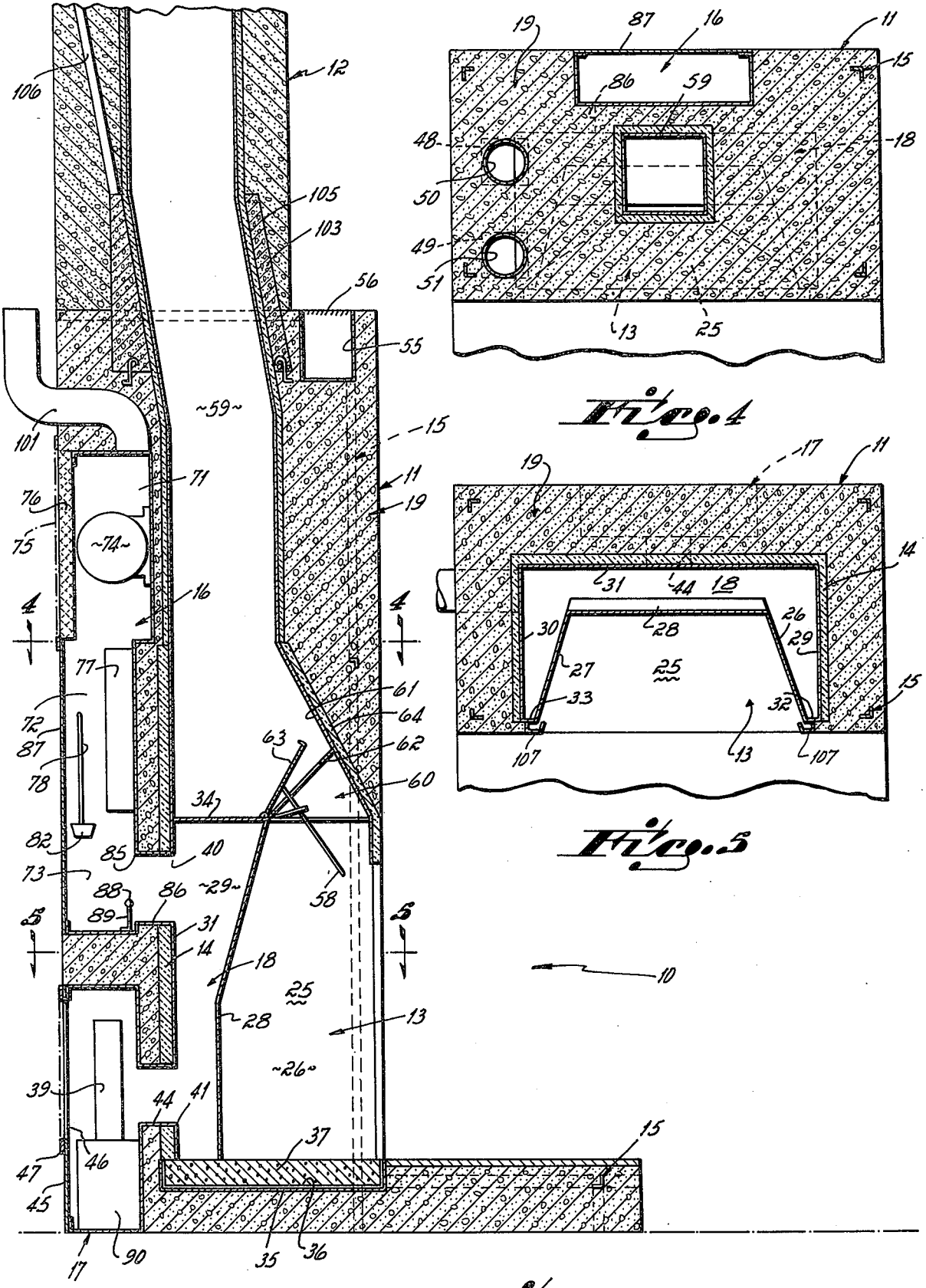
FIG. 2 is a cross-sectional view through the fireplace of FIG. 1 taken on line 2—2 of FIG. 1.
FIG. 4 is a cross-sectional view taken on line 4—4 of FIG. 2.
FIG. 5 is a cross-sectional view taken on line 5—5 of FIG. 2.
Figure 5:
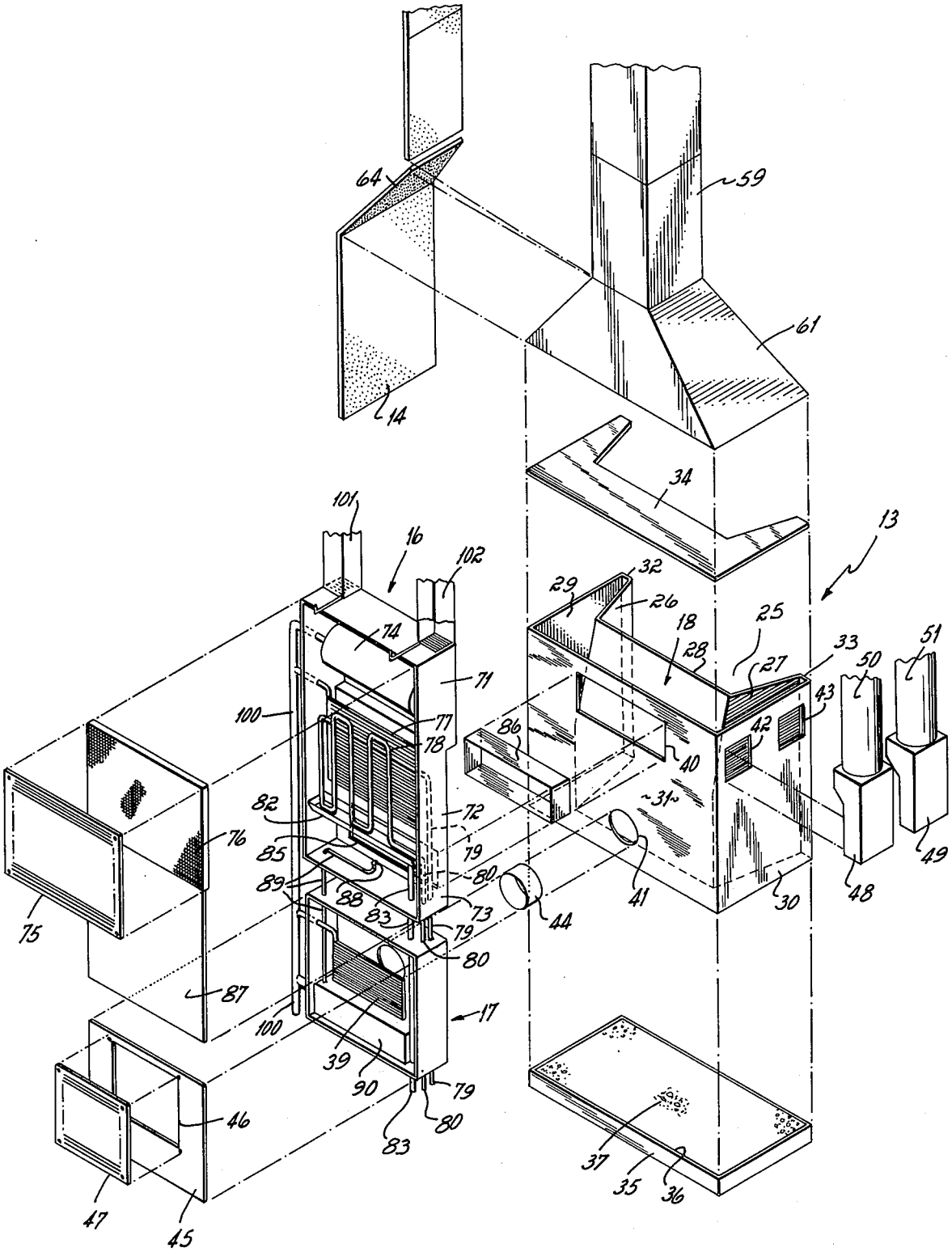

Referring to FIG. 1, there is illustrated a completed preferred embodiment of the invention which is so constructed that it can be completely prefabricated at a factory and transported as a unit to a building site. This prefabricated fireplace 10 comprises a lower fireplace section 11 and an upper chimney section 12. These two sections are preferably prefabricated and transported separately to a building site where the two sections are assembled.

In general, the lower fireplace section 11 comprises a prefabricated metal fireplace 13 surrounded by and encased within a thermal insulation 14. The metal fireplace unit is welded or otherwise secured to a metal frame 15 (illustrated completely in FIG. 6), and the complete metal fireplace, thermal insulation, and frame are encased within a masonry enclosure, in this embodiment a poured concrete enclosure 19. The concrete is preferably poured within a mold which has a Roman brick surface so that the completed fireplace has a brick textured exterior surface.

There is a pair of recesses formed in the rear of the enclosure. One of these recesses houses an air treatment control panel 16 and the other houses a service box control panel 17. As explained more fully hereinafter, the air treatment control panel controls the temperature of air supplied to an air distribution chamber 18 of the metal fireplace unit 13.

Figure 6:
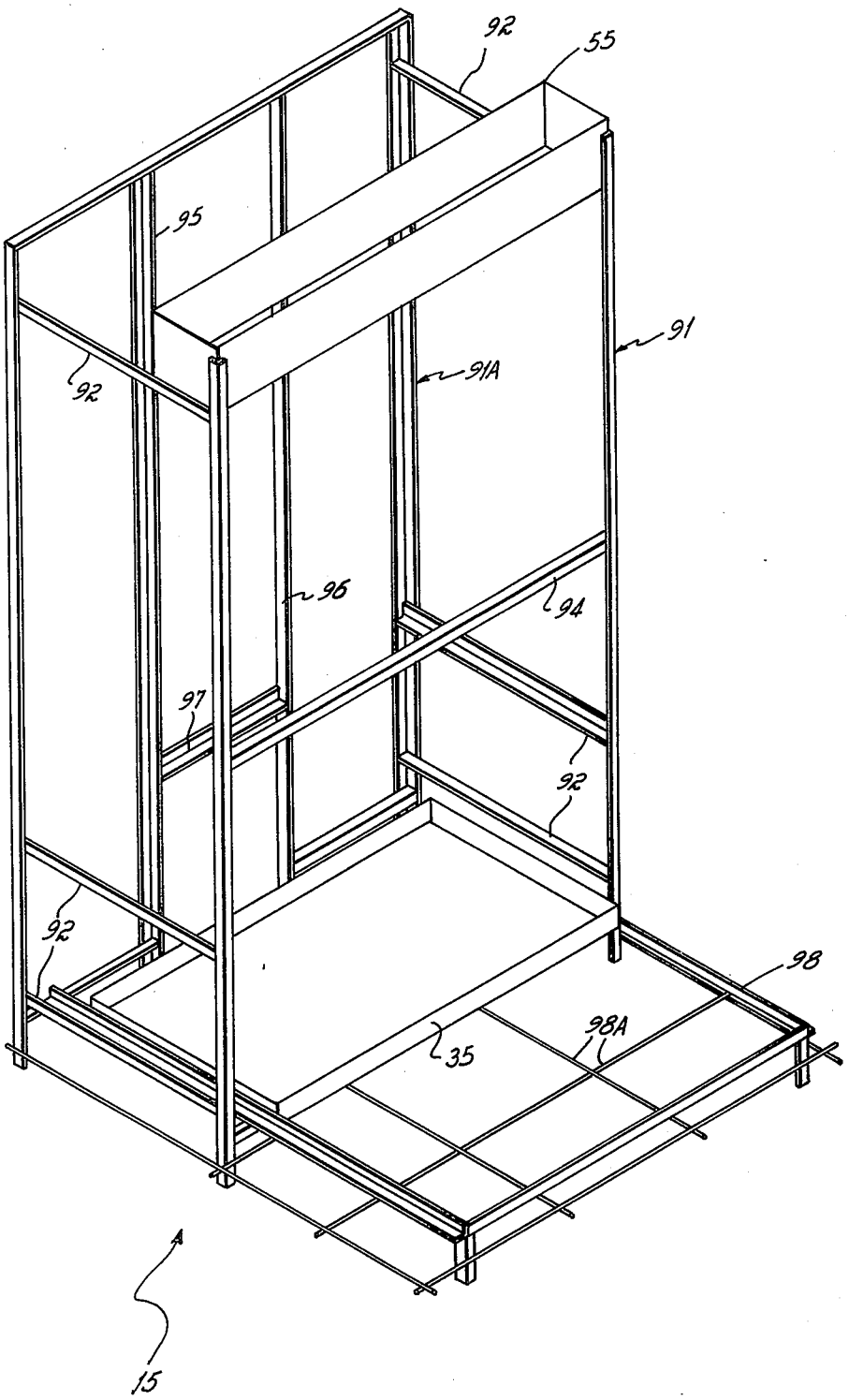
FIG. 6 is a perspective view of the total framework which is welded to the metal fireplace unit to enable the unit to be precast in concrete and/or covered with a brick exterior.

The metal fireplace 13 is prefabricated of sheet metal and is preferably welded into a unitary structure prior to assembly into the metal frame 15 (FIG. 6). It comprises the combustion chamber 25 enclosed by sidewalls 26, 27 and a rear wall 28. These three walls, 26, 27 and 28 form the inner walls of the air distribution chamber 18. The outer walls of this air distribution chamber comprise sidewalls 29 and 30, a rear wall 31, and a pair of front walls 32, 33. The inner and outer walls are all closed at the top by a smoke shelf 34.

The bottom of the metal fireplace 13 is formed by a hearth pan 35; this pan is made from sheet metal and is lined with an asbestos lining material 36. The pan is filled with a fireclay 37, whick fireclay forms the bottom of the combustion chamber 25 as well as the bottom of the air distribution chamber 18.

Air is supplied into the air distribution chamber through an air inlet port 40 in the rear wall 32 and is exhausted from the distribution chamber 18 through outlet ports 41, 42 and 43 located in the rear and side walls. These outlet ports may be located anywhere in the rear and side walls but in the illustrated embodiment, are exemplified by outlet port 41 in the rear wall and a pair of outlet ports 42, 43 in the side wall 30.

The outlet port 41 is connected by a neck 44 to the service box 17 on the rear of the fireplace 13. As explained more fully hereinafter this service box contains the electrical controls 90 for the unit as well as an auxiliary heater 39. The box 17 is closed by a service box panel 45 through which there is an outlet 46 covered by a grating 47. The auxiliary heater 39 is provided to enable air exhausted through the port 41 to be further heated by the electrical auxiliary heater before being dispensed into the room in which the fireplace is located.

The ports 42, 43 are connected to ducts 50, 51 by interconnecting conduits 48, 49. These conduits serve as a flow path from the ports 42, 43 of distribution chamber 18 into the ducts 50, 51 through which the air is distributed to the surrounding rooms. In the illustrated embodiment one of these ducts, 50, is enclosed within the concrete enclosure and opens into an air distribution trough, 55, above the fireplace. Air from the trough 55 is dispensed through a grating 56 into the room. The other duct, 51, extends through the concrete enclosure and terminates in an upper outlet grating (not shown) into the room.

Waste air from the combustion chamber 25 together with smoke and combustion products are transported upwardly from the combustion chamber through a damper 60 into a waste air disbursement hood 61 and then into the tiled flue 59. The waste air disbursement hood 61 is shaped as a truncated pyramid with an open top and open bottom. This hood rests on top of the smoke shelf 34 and is covered with a layer of insulation 64. Airflow between the combustion chamber 25 and the hood 61 is controlled by the damper 60 which comprises an apertured plate 62 mounted within the hood and an adjustable pivoted plate 63. The angulation or degree of opening of the pivoted plate 63 is controlled by a conventional adjustment rod 58 secured to the plate. When the damper is open, combustion products flow upwardly through the damper into the hood and from the hood up through the flue. It is to be noted, though, that there is no opening between the combustion chamber 25 and the air distribution chamber 18 so that smoke cannot flow from the combustion chamber into the distribution chamber 18; consequently, air in the distribution chamber is always clean air suitable for distribution into the surrounding rooms by a forced air blower system.

As mentioned hereinabove, an air treatment control panel 16 is connected to the air inlet 40 formed in the rear side of the air distribution chamber 18. This panel is divided into three compartments; an upper blower compartment 71, a central heating and cooling compartment 72, and a lower disbursement compartment 73. The upper compartment 71 houses a conventional electric motor-driven centrifical fan 74. This fan is operative to draw air through a cold air grating 75 and filter 76 into the air treatment control panel and to force that filtered air downwardly through the heating and cooling compartment 72. Within the heating and cooling compartment the air is heated or cooled, dependent upon which system is operating, by either an electric heating element 77 or cooling coils 78. The cooling coils are connected to a conventional condenser unit (not shown) by conduits 79 and 80 which extend downwardly from the coil 78 through the service box 17 to connecting lines which may be located either beneath the floor or in a concrete slab of the building in which the fireplace is located. Alternatively, the cooling coils may be connected to a conventional heat pump in which event they may function alternatively either as heating coils or cooling coils.

Preferably, a drip pan 82 is located immediately beneath the cooling coils and is connected by a drain line 83 to a sewer or other disposal line of the home in which the fireplace is located.

The disbursement compartment 73 of the air treatment control panel 16 has a rectangular opening 85 which is connected through a rectangular neck 86 with the opening 40 in the back of the fireplace distribution chamber 18. Because the rear side of the control panel is closed by a thermally lined, flat sheet metal panel 87, air forced by the blower 74 over the heating and cooling coils is caused to flow out of the control panel into the distribution chamber 18 of the fireplace.

There is preferably a thermostat 88 located within the disbursement chamber of the air treatment control panel. This thermostat is connected by a lead 89 to an electrical control box 90 contained within the service box control panel 17. This control box 90 houses the electrical controls which in response to actuation by the thermostat, cause the blower 74 and the electrical heater or the heat pump to be actuated.

The frame to which the complete metal fireplace unit 13 and the waste air disbursement hood 61 is fixedly secured by welds or other conventional attachments is illustrated in FIG. 6. This all-metal rigid frame is intended to locate the metal fireplace components and to hold them within the prefabricated concrete enclosure. The frame gives the concrete enclosure sufficient strength to enable the precast assembly to be picked up and moved as a unit from a maufacturing site to a building site. Alternatively, if the masonry enclosure is of brick, the parameters of the frame define the parameters for the brick enclosure.

As illustrated in FIG. 6, the metal frame is made from angle iron and concrete reinforcing rods. The frame 15 comprises front and rear rectangular sections 91, 91*a* connected by horizontally extending bars 92. The front rectangular section 91 is preferably reinforced by a horizontal bar 94 and the rear rectangular section 91*a* is preferably reinforced by vertical angles 95, 96 and a connecting horizontal brace 97.

The hearth of the fireplace comprises a lower rectangular horizontal frame 98 to which reinforcing rods 98*a* are welded. The hearth pan 35 is welded to the lower horizontal frame 98. The air outlet trough 55 is preferably welded to the front of the upper transverse angular iron 92. When connected to the duct 50, this trough 55 serves as an air distribution outlet for heated or conditioned air from the distribution chamber 18.

After assembly of the frame 15, the hearth pan 35 is lined with asbestos and filled with the fireclay hearth block 37. The metal fireplace 13 is then placed on top the hearth block and welded to the frame. The service block panel 17 and the air treatment control panel 16 are then secured to the frame together with the connecting necks 44 and 86. Similarly, the ducts 50, 51, the air flow connecting conduits 48, 49 and the electrical conduits 100 are secured to the frame. In the preferred embodiment there are also fresh air conduits 101, 102, connected to the frame for supplying fresh air from outside of the home to the top of the air treatment control panel 16. After securement of all of these conduits and connections to the frame, the complete assembly is placed within a mold preparatory to the pouring of concrete to form the complete lower fireplace section 11. In the preferred embodiment, the inside of the mold has a Roman brick inside surface configuration so that the completed concrete fireplace may be painted to give a brick exterior appearance.

The upper chimney section 12 is formed separately from the lower section 11. It, too, is formed within a mold within which the flue lining tile 59 is placed prior to the pour. So much reinforcing rod is placed within the mold as is required to reinforce and carry the weight of the upper section 12. Both the bottom of the upper section 12 and the top of the lower section 11 are poured with a cavity 105 for the reception of wet seal concrete 103. This cavity 105 is only filled with concrete after the upper section is assembled on top of the lower section 11 at the building site. At that time wet seal concrete is introduced through a conduit 106 embedded in the concrete of the upper section 12. This wet seal concrete when hardened forms a seal to prevent the egress of smoke between the two sections 11 and 12 of the fireplace.

Once assembled on the building site, the prefabricated fireplace 10 is connected to service lines which may be either located in the floor or ceiling of the building within which the fireplace is located. These service lines comprise electrical power lines to the electrical service box 90 as well as a drain line connected to the line from the drip pan and compressor conduits to the cooling coil on heat pump lines 79 and 80. The electrical leads are also connected to the blower fan 74 and the electrical heater 77.

Operation of the fan, the condenser, the heating coils and/or the heat pump are all controlled by the thermostat 88. When actuated under the control of the thermostat, the fan 74 is operative to draw air through the cold air return grate 75 and filter 76 into the air treatment control panel and to force it downwardly over the coils 77 and 78. This air is then forced to flow through the disbursement or outlet compartment 85 of the air treatment control panel into the distribution chamber 18. In the event that there is a fire within a combustion chamber 25 of the fireplace, the air picks up heat from the side walls of the distribution chamber 18. From the distribution chamber 18 the temperature conditioned air is distributed via the conduits 50, 51 to the outlying points within the room in which the fireplace is located or other rooms of the home within the fireplace is located.

In one preferred embodiment of the invention, there are generally U-shaped deflection bars 107 welded to the front walls 32, 33 of the metal fireplace 13. these deflector bars 107 cooperate with small orifices (not shown) in the front walls 32, 33 to direct forced air from the distribution chamber 18 into the fireplace combustion chamber 25 for hotter burning fires.

The temperature conditioned air may be caused to flow over auxiliary electrical heaters 39 located in the grate covered outlet boxes to further heat the conditioned air in the event that selected areas are to be heated to a greater extent than is possible with the heaters contained within the air temperature control panel of the fireplace.

One of the advantages of this fireplace is the versatility which accompanies its use. Depending upon the particular auxiliary equipment used in association with it, it may be used as a complete heating and cooling system in varying sizes and configurations of homes.

Figure 7:
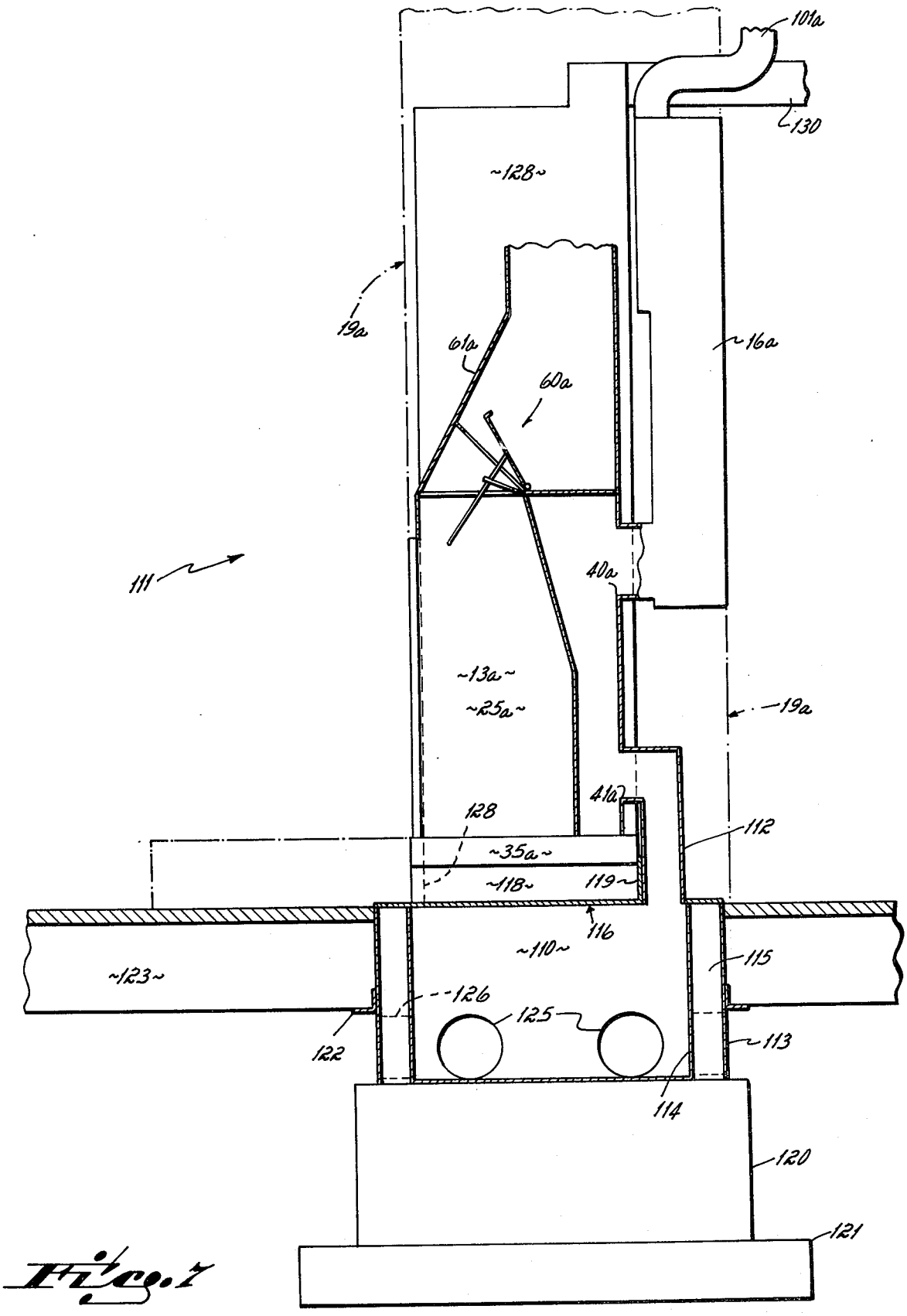
FIG. 7 is a cross-sectional view of a second embodiment of fireplace unit incorporating the invention of this application.
Figure 8:
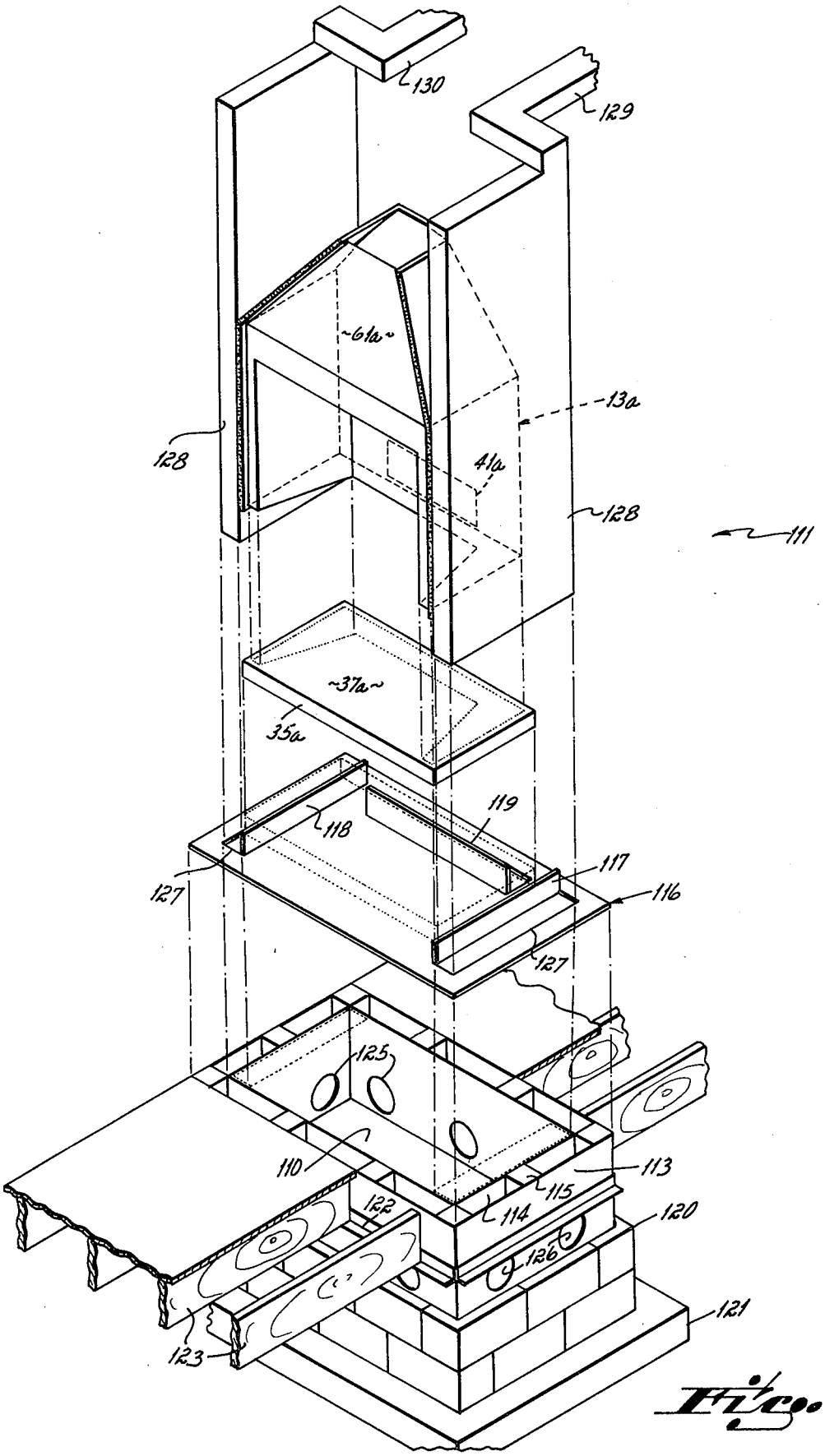
FIG. 8 is an exploded perspective view of the fireplace of FIG. 7.

Referring to FIGS. 7 and 8, there is illustrated a second embodiment of the invention of this application. This second embodiment differs from the embodiment of FIGS. 1 through 6 principally in that it includes a plenum chamber 110 located beneath the fireplace and through which all treated air is distributed to the ductwork of the home within which the fireplace is located. The primary advantage of this plenum chamber is that it enables the ductwork to be located beneath the floor level of the room within which the fireplace is located.

Those portions or elements of the fireplace of this embodiment which correspond to identical components of the embodiment of FIGS. 1 through 6 have been given the same numerical designation followed by the suffix "*a*".

The fireplace 111 comprises the metal fireplace unit 13*a* which is identical to the metal fireplace 13 of FIGS. 1 through 6 except that it does not have the discharge ports 42 and 43. Additionally, the discharge port 41*a* is rectangular rather than circular and of approximately the same cross-sectional area as the inlet port 40*a*. In this embodiment all of the airflow through the distribution chamber 18*a* enters through the inlet port 40*a* and is discharged through the single outlet port 41*a*. The outlet port discharged air then is directed by a rectangular duct 112 downwardly into the plenum chamber 110.

The plenum chamber 110 comprises a two-ply, sidewall chamber; the individual plies 113, 114 of which are separated by baffle plates 115. The area between the baffle plates 115 is filled with concrete so as to form vertical concrete columns to reinforce the sidewalls of the plenum chamber.

The top of the plenum chamber is closed by a coverplate 116 which is welded onto the top of the plenum chamber. This coverplate has three apertures formed in it by upwardly bent flanges 117, 118 and 119. The two side flanges 117 and 118 in the preferred embodiment extend upwardly approximately 4 inches while the rear flange 119 extends upwardly approximately four and three quarters inches. In this embodiment the fireclay filled hearthpan 35*a* rests atop the side flanges 117 and 118 and has its rear surface resting against the front face of the rear flange 119. The hearthpan is preferably secured to the coverplate 116 by being welded to the flanges 117, 118, and 119.

The plenum chamber rests atop and is supported from a block foundation 120. That block foundation in turn rests atop a conventional footing 121 of poured concrete.

Around the exterior of the plenum chamber there is a sill angle 122. This horizontally extending angle 122 is welded to the exterior of the plenum chamber and functions to support the floor joists 123 of the room in which the fireplace is located, or if the floor is a concrete slab, the angle 122 supports the edge of that slab.

There are a number of side ports 125 provided in the sidewalls of the plenum chamber. These ports are preferably formed by knockout plugs and are interconnected by sleeves 12*b*. Transport ducts for transporting heated or cooled air from the plenum chamber are connected to these outlet ports.

In addition to the outlet ports 125, outlet air may be disbursed from the plenum chamber through the outlet ports 127 of the coverplate 116. These side ports 127 communicate with the open bottom of side transport ducts 128. These side transport ducts 128 are spaced from the exterior sidewall 29*a*, 30*a* of the metal fireplace by the compressible insulative layer 14*a* which surrounds the metal fireplace and the waste air disbursement hood 61*a*. At the top, the side transport ducts 128 open into overhead ducts 129 and 130. Heated or conditioned air may be transported from the fireplace to other areas of the room or rooms located around the fireplace via these overhead ducts 129, 130.

In operation, air is supplied to the fireplace 111 of this second embodiment through the cold air return grate filter (not shown) at the top of the air treatment control panel 16*a*. This air is then forced downwardly through the panel 16*a* by a blower (not shown) located therein. In the course of passing downwardly through the air treatment control panel 16*a* the air is either heated or cooled by the heating or cooling coils contained therein. The treated air is then directed from the lower end of the air treatment control panel 16*a* into the distribution chamber 18*a* of the metal fireplace. In the course of passing through the distribution chamber 18*a*, the air may pick up heat from the side and rear walls 26*a*, 27*a* and 28*a* of the distribution chamber if there is a fire within the combustion chamber of the metal fireplace 13*a*. The conditioned air is then directed from the distribution chamber through the outlet port 41*a* and downwardly into the plenum chamber 110. From the plenum chamber the air is either directed outwardly to the surrounding room or rooms via the outlet ports 125 and connecting ducts or via the side transport ducts 128 and overhead ducts 129, 130.

This second embodiment because of the inclusion of the plenum chamber better lends itself to the transport of heated or conditioned air beneath the floors of the home within which the fireplace is located. This construction also lends itself to onsite enclosure of the metal fireplace within an onsite constructed brick enclosure rather than a precast concrete enclosure as in the illustrated embodiment of the FIGS. 1 through 6.

The primary advantage of the fireplace of both of the embodiments of this invention is that both comprise a very flexible and versatile total home heating and cooling package of which the fireplace is the distribution center. Both use heat from the woodburning fireplace to a maximum extent and minimize heat loss of fireplace generated heat. Both also provide a very flexible home heating system in which the conventional home heating and air conditioning ducts function also as distribution ducts for fireplace heated air.

While I have described only two embodiments of my invention, persons skilled in the area to which it pertains will readily appreciate other changes and modifications which may be made without departing from the spirit of my invention. Therefore, I do not intend to be limited except by the scope of the appended claims.

Having described my invention, I claim:

1. A prefabricated fireplace assembly including a complete home heating and cooling system comprising, in combination, a rigid metal framework and a masonry enclosure surrounding said rigid metal framework defining front and rear masonry fireplace walls, an open-front fireplace combustion chamber defined by a hearth floor, side walls, a rear wall, and a flue opening for exhaust of combustion products, said chamber being mounted within said framework and opening at said front fireplace wall, an air distribution chamber surrounding said combustion chamber and being in heat exchange relationship with the walls thereof, said air distribution chamber having inner side walls and a rear wall adjacent said combustion chamber side walls and rear wall, said air distribution chamber further having outer side walls and a rear wall spaced from said inner side walls being interconnected by top and bottom walls, and a pair of front walls interconnecting said inner and outer side walls of said air distribution chamber, said distribution chamber further having an air inlet, and at least one air outlet, a chimney, a waste air dispensing hood mounted above said air distribution chamber and interconnecting said flue opening of said combustion chamber and said chimney, first and second recesses spaced behind said air distribution chamber, said recesses having at least one opening for the inlet and outlet of air, respectively, said first recess including a blower compartment, a heating and cooling compartment, and a disbursement compartment, said first and second recesses communicating with said air distribution chamber through said air inlet and said air outlet of said distribution chamber, respectively, blower means mounted in said blower compartment for inducting air into said first recess and forcing said air through said air distribution chamber and said second recess, the inducted air coming into heat exchange relationship with the walls of said fireplace combustion chamber as it passes through said air distribution chamber, heating and air conditioning means mounted in said heating and cooling compartment for conditioning the temperature of air passing therethrough, and air flow ducts for supplying conditioned air from said distribution chamber air outlet to areas surrounding said fireplace, said combustion chamber, said distribution chamber, said recess and said dispensing hood being surrounded and enclosed within said rigid metal framework and masonry.

2. The fireplace assembly of claim 1 wherein said first recess includes an upper blower compartment, a central heating and cooling compartment, and a lower disbursement compartment, said lower disbursement compartment communicating with said air distribution chamber through said air inlet thereof.

3. The fireplace assembly of claim 1 wherein said masonry enclosure is precast concrete.

4. The fireplace assembly of claim 1 wherein said opening of said first recess is in said rear masonry fireplace wall and further comprising a grate covering said opening.

5. The fireplace assembly of claim 4 wherein said opening of said second recess is in said rear masonry fireplace wall and further comprising a grate covering said opening.

6. The fireplace assembly of claim 1 further comprising a prefabricated metal plenum chamber located beneath said hearth and having at least one inlet in communication with said distribution chamber outlet, and air flow ducts for supplying conditioned air from said plenum chamber to areas surrounding said fireplace.

* * * * *

UNITED STATES PATENT AND TRADEMARK OFFICE

CERTIFICATE OF CORRECTION

PATENT NO. : 3,999,535

DATED : December 28, 1976

INVENTOR(S) : John R. Hall

It is certified that error appears in the above-identified patent and that said Letters Patent are hereby corrected as shown below:

Col. 2, line 42 "total" should be -- metal --

Col. 3, line 27, "32" should be -- 31 --

Col. 6, line 10, after "within" insert -- which --

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*